US008741197B2

(12) United States Patent
Gabbay

(10) Patent No.: US 8,741,197 B2
(45) Date of Patent: Jun. 3, 2014

(54) ANTIMICROBIAL, ANTIFUNGAL AND ANTIVIRAL RAYON FIBERS

(75) Inventor: Jeffrey Gabbay, Jerusalem (IL)

(73) Assignee: Cupron Inc., Richmond, VA (US)

( * ) Notice: Subject to any disclaimer, the term of this patent is extended or adjusted under 35 U.S.C. 154(b) by 39 days.

(21) Appl. No.: 11/692,884

(22) Filed: Mar. 28, 2007

(65) Prior Publication Data

US 2008/0241530 A1 Oct. 2, 2008

(51) Int. Cl.
*B29C 47/00* (2006.01)
*D02G 3/00* (2006.01)

(52) U.S. Cl.
USPC ..... 264/188; 264/176.1; 264/196

(58) Field of Classification Search
USPC ..... 264/176.1, 188, 196
See application file for complete search history.

(56) References Cited

U.S. PATENT DOCUMENTS

| | | | | |
|---|---|---|---|---|
| 2,395,015 | A * | 2/1946 | Schlosser et al. | 264/37.23 |
| 3,341,645 | A * | 9/1967 | Horiuchi et al. | 264/196 |
| 3,432,589 | A * | 3/1969 | Drisch | 264/197 |
| 3,494,995 | A * | 2/1970 | Rainer et al. | 264/196 |
| 3,632,721 | A * | 1/1972 | Asaeda | 264/196 |
| 3,632,722 | A * | 1/1972 | Asaeda | 264/196 |
| 3,632,723 | A * | 1/1972 | Asaeda | 264/196 |
| 3,720,743 | A * | 3/1973 | Stevens et al. | 264/168 |
| 3,875,141 | A * | 4/1975 | Drisch | 536/57 |
| 4,361,532 | A * | 11/1982 | Benai et al. | 264/188 |
| 5,023,131 | A * | 6/1991 | Kwok | 442/416 |
| 6,261,679 | B1 * | 7/2001 | Chen et al. | 428/317.9 |
| 6,692,603 | B1 * | 2/2004 | Lindsay et al. | 156/209 |
| 7,169,402 | B2 | 1/2007 | Gabby | |
| 7,296,690 | B2 | 11/2007 | Gabby | |
| 7,364,756 | B2 | 4/2008 | Gabby | |
| 2002/0148050 | A1 * | 10/2002 | Luo et al. | 8/115.51 |
| 2004/0167484 | A1 | 8/2004 | Gabby | |
| 2004/0167485 | A1 | 8/2004 | Gabby | |
| 2004/0197386 | A1 | 10/2004 | Gabby | |
| 2004/0247653 | A1 * | 12/2004 | Gabbay | 424/443 |
| 2005/0049370 | A1 | 3/2005 | Gabby | |
| 2005/0050514 | A1 | 3/2005 | Gabby | |
| 2006/0086284 | A1 * | 4/2006 | Zhang et al. | 106/15.05 |
| 2006/0177879 | A1 * | 8/2006 | Mayes et al. | 435/7.5 |
| 2006/0281961 | A1 * | 12/2006 | Prasad | 588/300 |

(Continued)

FOREIGN PATENT DOCUMENTS

| | | | | |
|---|---|---|---|---|
| DE | 3415703 | * | 8/1984 | D01D 5/06 |
| EP | 1978138 | A2 | 10/2008 | |

(Continued)

OTHER PUBLICATIONS http://en.wikipedia.org/wiki/Rayon (wiki free encyclopedia).*

(Continued)

*Primary Examiner* — Joseph S Del Sole
*Assistant Examiner* — Nahida Sultana
(74) *Attorney, Agent, or Firm* — Kilpatrick Townsend & Stockton LLP

(57) ABSTRACT

The invention provides an antimicrobial, antifungal and antiviral polymeric material, comprising rayon fibers and a single antimicrobial, antifungal and antiviral component consisting essentially of microscopic water insoluble particles of copper oxide incorporated in said fibers wherein a portion of said particles in said fibers are exposed and protruding from the surface of the fibers and wherein said particles release $Cu^{++}$ when exposed to water or water vapor.

5 Claims, 1 Drawing Sheet

(56) References Cited

U.S. PATENT DOCUMENTS

| | | | | |
|---|---|---|---|---|
| 2007/0010155 | A1* | 1/2007 | Branham et al. | 442/327 |
| 2007/0184079 | A1 | 8/2007 | Gabby | |
| 2008/0044651 | A1* | 2/2008 | Douglas | 428/339 |
| 2008/0138385 | A1* | 6/2008 | Fukatsu et al. | 424/443 |
| 2008/0193496 | A1 | 8/2008 | Gabby | |
| 2008/0241530 | A1* | 10/2008 | Gabbay | 428/372 |
| 2008/0255285 | A1 | 10/2008 | Gabby | |
| 2008/0311165 | A1 | 12/2008 | Gabby | |
| 2009/0010969 | A1 | 1/2009 | Gabby | |
| 2009/0252861 | A1* | 10/2009 | Tessier et al. | 427/2.31 |
| 2010/0204289 | A1* | 8/2010 | Lodha et al. | 514/372 |

FOREIGN PATENT DOCUMENTS

| | | | | |
|---|---|---|---|---|
| JP | 3097909 | A | 4/1991 | |
| JP | 4011017 | A | 1/1992 | |
| JP | 4058876 | A | 2/1992 | |
| WO | WO 01/74166 | A | 10/2001 | |
| WO | WO 03/035973 | A | 5/2003 | |
| WO | WO 2005/020689 | A | 3/2005 | |
| WO | WO 03035973 | * | 5/2005 | D01F 1/10 |
| WO | WO 2005/100662 | A1 * | 10/2005 | D04H 13/00 |
| WO | WO 2006/048879 | A | 5/2006 | |
| WO | WO 2008/117277 | A2 | 10/2008 | |

OTHER PUBLICATIONS

Extended European Search Report of Jan. 8, 2009 for European Application 07251923.4-1217.

"Israeli Breakthrough Mines Copper to Keep Bacteria Away," ISRAEL21C (revised Feb. 21, 2007) Retrieved Dec. 18, 2008 from URI:http://www.israe121c.org/bin/en.jsp?en Script=PrintVersion.jsp&enDispWho=Articles%SE11172.

PCT International Preliminary Report on Patentability (Chapter I) with Written Opinion of Sep. 29, 2009 for application PCT/IL2008/000390.

PCT Search Report mailed Apr. 2, 2009 for application PCT/IL2008/000390.

US 7,284,669, 10/2007, Gabby (withdrawn)

* cited by examiner

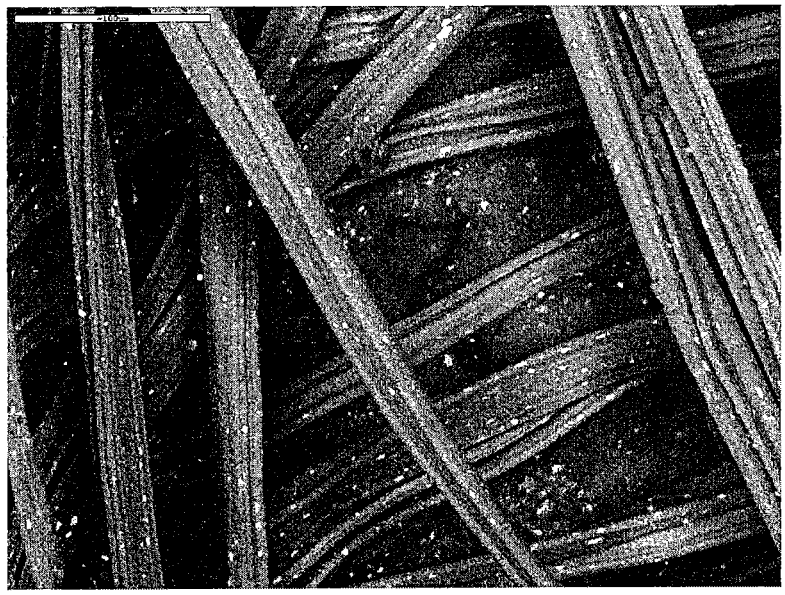
100μm

ANTIMICROBIAL, ANTIFUNGAL AND ANTIVIRAL RAYON FIBERS

FIELD OF THE INVENTION

The present invention relates to copper-impregnated rayon fibers with antimicrobial, antifungal and antiviral properties.

BACKGROUND OF THE INVENTION

Antibacterial fibers may be used in manufacture of fabrics, condoms, filters, diapers, bed linens, and other articles in which it is desirable to kill or retard growth of bacteria, fungi or viruses. A variety of approaches have been used to produce such fibers. For example, PCT publication WO 98/06508 describes an antibacterial textile in which fibers are plated with a metal or metal oxide. U.S. Pat. No. 7,169,402, which is incorporated herein by reference, describes polymers such as polyamide, polyester, and polypropylene which contain microscopic particles of copper oxide and exhibit antibacterial properties.

Viscose rayon is a manufactured regenerated cellulosic fiber widely used in manufacture of textiles (e.g., apparel), feminine hygiene products, and medical surgical products. The process of manufacturing viscose rayon usually includes the following steps (or equivalents): (1) Steeping, (2) Shredding, (3) Aging, (4) Xanthation, (5) Dissolving, (6) Ripening, and (7) Spinning. The various steps involved in the process of manufacturing viscose are known in the textile arts (see, e.g., Encyclopedia of Chemical Technology Third Edition, 1982, Vol. 19, pages 855-880, John Wiley & Sons, which is incorporated herein by reference) and are described below.

Rayon textiles asserted to have antibacterial properties have been described. For example, Daiwabo Rayon Ltd (Japan) markets rayon containing light-responsive ceramics purported to have antibacterial properties. U.S. Pat. No. 6,344,077 describes rayon containing chitosan, alginic acid or derivatives of these compounds purported to have antibacterial properties, and to be water-soluble. However, a need remains for rayon fibers that are stable, economical, and have effective antimicrobial, antifungal and antiviral properties.

BRIEF SUMMARY

In one aspect the invention provides a rayon fiber comprising microscopic water insoluble particles of copper oxide incorporated in said fibers, wherein a portion of said particles in said fibers are exposed and protruding from the surface of the fibers and wherein said particles release $Cu^{++}$ when exposed to water or water vapor. In another aspect of the present invention, there is provided a rayon product comprising microscopic water insoluble particles of copper oxide incorporated in said product wherein a portion of said particles in said product are exposed and protrude from the surface of the product and wherein said particles release $Cu^{++}$ when exposed to water or water vapor. In one embodiment of the present invention, particles are of a size of between 0.5 and 2 microns and are present in an amount of between 0.25 and 10% of the cellulose weight. In preferred embodiments of the present invention the microscopic water insoluble particles of copper oxide are selected from the group consisting of cupric oxide particles, cuprous oxide particles, and mixtures thereof.

In a related aspect the invention provides a method of making a rayon fiber with antibacterial, antifungal and/or antiviral propertied comprising (i) adding copper oxide particles to a rayon viscose and (ii) extruding the viscose through a spinnerette into an acid bath. In one embodiment the acid bath comprises sulfuric acid. In one embodiment the method comprises the viscose rayon manufacturing steps of (1) Steeping, (2) Pressing, (3) Shredding, (4) Aging, (5) Xanthation, (6) Dissolving to form a viscose, (7) Ripening the viscose, (8) Filtering the viscose, (9) Degassing the viscose, (10) Spinning, and (11) Stretching, wherein copper oxide powder is added to the viscose.

In a related aspect the invention provides cloth, fabric, yarn or thread comprising a rayon fiber as described above.

BRIEF DESCRIPTION OF THE FIGURE

FIG. 1 is an electron microscope photograph of rayon fibers with copper particles embedded therein and protruding there from after having been added to a polymeric slurry. Scale bar in upper left-hand corner=100 microns.

DETAILED DESCRIPTION

In one aspect the invention provides rayon fibers with antimicrobial, antifungal and/or antiviral material properties. The rayon fibers comprise microscopic water insoluble particles of copper oxide which are incorporated in the fibers, where a portion of the particles are exposed and protruding from the surface of the fibers, and where the particles release $Cu^{++}$ when exposed to water or water vapor.

Rayon is made by converting purified cellulose into cellulose xanthate, dissolving the cellulose xanthate in a dilute caustic solution to produce a viscous solution (or more accurately, suspension) referred to as "viscose", and then regenerating the cellulose by forcing the viscose through a spinneret into an acid bath. Rayon fibers of the invention may be made by adding microscopic particles of copper oxide to the viscose.

Production of Rayon Fibers

The process of producing rayon will be described in greater detail to aid in the understanding of the invention.

The process of manufacturing viscose rayon includes a series of steps, which have been characterized as (1) Steeping, (2) Pressing, (3) Shredding, (4) Aging, (5) Xanthation, (6) Dissolving, (7) Ripening, (8) Filtering, (9) Degassing, (10) Spinning, and (11) Stretching or Drawing. According to the invention, copper oxide particles are added prior to the spinning step. In a preferred embodiment of the present invention, copper oxide powder is added in the "dissolving" step. In a preferred embodiment of the present invention, copper oxide powder is added in the final stage of dissolving, which involves a mixing process.

There are a variety of plasticizers used in the manufacture of viscose fibers which give different qualities to the fiber such as increased absorption of liquids or tensile strength as examples. These plasticizers can be added at different stages but often are added at the xanthation or dissolving or spinning stages. In the present invention, to avoid the reaction of the high acid atmosphere, the copper oxide powder is preferably added just before the rayon is extruded through the spinneret (spinning stage).

It will be understood by those of skill that, notwithstanding the listing of these particular steps, that there are numerous variations known in the art of rayon production. For example, after spinning the fibers are usually washed and cut, and may be finished for subsequent textile processing. Various agents (e.g., plasticizers and spinning additives) may be added to the viscose and/or acid bath may be added. For example, typically the acid bath contains salt (such as sodium sulfate), zinc, an amine (e.g., dimethylamine) and polyetherglyol. In a preferred embodiment the acid bath contains sodium sulfate. In a preferred embodiment of the invention the acid bath contains zinc and sodium sulfate. See, e.g., Encyclopedia of Chemical Technology Third Edition supra.

1. Steeping

Cellulose (e.g., cellulose-pulp sheets) is saturated with a solution of caustic soda (or sodium hydroxide) and allowed to steep for enough time for the caustic solution to penetrate the cellulose and convert some of it into "soda cellulose", the sodium salt of cellulose. This is necessary to facilitate controlled oxidation of the cellulose chains and the ensuing reaction to form cellulose xanthate. Purified cellulose for rayon production usually comes from specially processed wood pulp. It is sometimes referred to as "dissolving cellulose" or "dissolving pulp" to distinguish it from lower grade pulps used for papermaking and other purposes. Dissolving cellulose is characterized by a high alpha-cellulose content, i.e., it is composed of long-chain molecules, relatively free from lignin and hemicelluloses, or other short-chain carbohydrates.

2. Pressing

The soda cellulose is squeezed mechanically to remove excess caustic soda solution.

3. Shredding

The soda cellulose is mechanically shredded to increase surface area and make the cellulose easier to process. In addition, shredding distributes the caustic more uniformly in the cellulose. This shredded cellulose is often referred to as "white crumb".

4. Aging

The white crumb is allowed to stand in contact with the oxygen of the ambient air. Because of the high alkalinity of white crumb, the cellulose is partially oxidized and degraded to lower molecular weights. This degradation must be carefully controlled to produce chain lengths short enough to give manageable viscosities in the spinning solution, but still long enough to impart good physical properties to the fiber product.

5. Xanthation

The properly aged white crumb is placed into a churn, or other mixing vessel, and treated with gaseous carbon disulfide. The soda cellulose reacts with the $CS_2$ to form xanthate ester groups. The carbon disulfide also reacts with the alkaline medium to form inorganic impurities which give the cellulose mixture a characteristic yellow color—and this material is referred to as "yellow crumb".

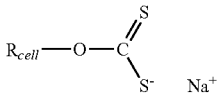

Because accessibility to the $CS_2$ is greatly restricted in the crystalline regions of the soda cellulose, the yellow crumb is essentially a block copolymer of cellulose and cellulose xanthate.

6. Dissolving & Addition of Copper Oxide

The yellow crumb is dissolved in aqueous caustic solution with mixing (e.g., stirring). The large xanthate substituents on the cellulose force the chains apart, reducing the interchain hydrogen bonds and allowing water molecules to solvate and separate the chains, leading to solution of the otherwise insoluble cellulose. Because of the blocks of un-xanthated cellulose in the crystalline regions, the yellow crumb is not completely soluble at this stage. Because the cellulose xanthate solution (or more accurately, suspension) has a very high viscosity, it has been termed "viscose".

Typically a raw copper oxide powder is used. Alternatively, the copper oxide particles can be encapsulated in materials such as a polyurethane surfactant to facilitate dispersion and reduce agglomeration in the liquid viscose. This coating will disappear instantaneously when the powder is placed in the rayon acid bath. If a coating is used, the particles can be at other stages of the rayon synthesis process.

In general the copper oxide particle size is a particle size capable of passing through the spinneret holes. In one embodiment the average particle size is in the range about 0.5 microns to about 4 microns, preferably about 1 micron to about 2 microns. In one embodiment the average particle size is about 1 micron. In one embodiment the particles have an average dimension of about 1 micron and the population of particles is substantially free of particles larger than 2 microns.

In preferred embodiments of the present invention, said particles are present in an amount of between 0.25 and 10% of the initial cellulose dry weight. In a preferred embodiment, a 0.5% to 3% copper oxide powder weight to dry cellulose weight concentration is used.

In one embodiment the water insoluble particles of copper oxide consist of cupric oxide particles. In one embodiment the water insoluble particles of copper oxide consist of cuprous oxide particles. In one embodiment the water insoluble particles of copper oxide consist of mixture of cupric oxide particles and cuprous oxide particles.

In some embodiments the fiber is essentially free (i.e., less than 0.1%, preferably less than 0.01%) of microscopic particles other than copper oxide particles. In some embodiments the fiber does not contain antibacterial agents other than copper oxide. In some embodiments the fiber does not contain antifungal agents other than copper oxide. In some embodiments the fiber does not contain antiviral agents other than copper oxide. In some embodiments the fiber does not contain a metal oxide other than copper oxide. In some embodiments the fiber does not contain microscopic particles other than copper oxide particles (where a microscopic particle is a solid, non-cellulose, particle having a dimension in the range 0.1 micron to 50 microns, or in the range 1 micron to 10 microns).

7. Ripening

The viscose is allowed to stand for a period of time to "ripen". Two important processes occur during ripening: Redistribution and loss of xanthate groups. The reversible xanthation reaction allows some of the xanthate groups to revert to cellulosic hydroxyls and free $CS_2$. This free $CS_2$ can then escape or react with other hydroxyl on other portions of the cellulose chain. In this way, the ordered, or crystalline, regions are gradually broken down and more complete solution is achieved. The $CS_2$ that is lost reduces the solubility of the cellulose and facilitates regeneration of the cellulose after it is formed into a filament.

8. Filtering

The viscose is filtered to remove undissolved materials that might disrupt the spinning process or cause defects in the rayon filament.

9. Degassing

Bubbles of air entrapped in the viscose must be removed prior to extrusion or they would cause voids, or weak spots, in the fine rayon filaments.

10. Spinning

Due to the viscosity of the rayon viscose it was expected that the copper particles would sink to the bottom of the mulch because of their relatively high specific gravity, however, surprisingly the copper oxide powder remained in suspension. Nevertheless, to assure an even distribution it is recommended to keep the mulch in constant stirring motion.

The viscose is forced through a spinneret device resembling a hower head with many small holes. Each hole produces a fine filament of viscose. As the viscose exits the spinneret, it comes in contact with a solution of sulfuric acid, sodium sulfate and, usually, $Zn^{++}$ ions. Several processes occur at this point which cause the cellulose to be regenerated and precipitate from solution. Water diffuses out from the extruded viscose to increase the concentration in the filament beyond the limit of solubility. The xanthate groups form complexes with the $Zn^{++}$ which draw the cellulose chains together. The acidic spin bath converts the xanthate functions into unstable xantheic acid groups, which spontaneously lose $CS_2$ and regenerate the free hydroxyls of cellulose. (This is similar to the well-known reaction of carbonate salts with acid to form unstable carbonic acid, which loses $CO_2$). The result is the formation of fine filaments of cellulose, or rayon.

One of the unexpected aspects of the present invention is that one would have expected that the exposure to the acid would have caused a return of the copper oxide to solution whereby production of rayon fibers incorporating copper particles would not be achievable however, surprisingly, this did not occur.

11. Drawing

The rayon filaments are stretched while the cellulose chains are still relatively mobile. This causes the chains to stretch out and orient along the fiber axis. As the chains become more parallel, interchain hydrogen bonds form, giving the filaments the properties necessary for use as textile fibers.

12. Washing

The freshly regenerated rayon contains many salts and other water soluble impurities which need to be removed. Several different washing techniques may be used.

13. Cutting

If the rayon is to be used as staple (i.e., discreet lengths of fiber), the group of filaments (termed "tow") is passed through a rotary cutter to provide a fiber which can be processed in much the same way as cotton.

Rayon Fibers

Rayon fibers made by adding copper oxide powder to viscose are shown in FIG. 1. The electron micrograph shows rayon fibers with copper particles partially embedded (i.e., microscopic water insoluble particles of copper oxide are incorporated in the rayon fibers, wherein portions of individual particles in said fibers are exposed and protruding from the surface of the fibers). FIG. 1 of U.S. Pat. No. 7,169,402 shows a nylon fiber with similarly configured copper oxide particles. The antimicrobial materials of U.S. Pat. No. 7,169,402 were made by, e.g., preparing a slurry of a polymer such as polyamide, polyester, or polypropylene, adding copper oxide at the hot mixing stage, and pushing the liquid slurry through holes in a series of metal plates formed into a circle called a spinneret. As the slurry is pushed through the fine holes which are close together, they form single fibers or if allowed to contact one another, they form a film or sheath. The hot liquid fiber or film is pushed upward with cold air forming a continuous series of fibers or a circular sheet. The thickness of the fibers or sheet is controlled by the size of the holes and speed at which the slurry is pushed through the holes and upward by the cooling air flow.

The method of production of rayon is quite different from production of polymers such as polyamide, polyester, and polypropylene, and it was quite surprising that rayon fibers comprising copper oxide particles incorporated therein and protruding from the surfaces thereof could be prepared as described herein. In particular, copper oxide dissolves in mineral acids such as hydrochloric acid, sulfuric acid or nitric acid to give the corresponding copper salts. It was expected that the exposure to the acid required for the final spinning step would dissolve the copper oxide and put it back in solution.

Cellulose is characterized by zinc-cellulose complexes in the fiber (see, Kurek, 2002, *Proc. Nat'l. Acad. Sci. USA* 99: 11109-14). Because the xanthation step involves breaking down of the cellulose high levels of zinc are released. It was therefore surprising that the exposure to a copper ion did not affect the fiber characteristics, given the expected interactions of zinc and copper.

Furthermore, due to the viscosity of the rayon viscose (about 1-1.1) it was expected that the copper oxide particles (which have a specific gravity of almost 6), would sink to the bottom of the viscose. However, surprisingly it was found that the copper oxide powder remained in suspension.

Thus for all of these reasons, it was surprising that in spite of the presence of zinc which was expected to cause a reduction of the copper and regardless of the presence of acid which would be expected to put the copper oxide back into the solution, the rayon fibers have the same structure formation as a complete synthetic such as polyester or nylon which are not exposed to acid.

Biological Activity

Fibers having microscopic water insoluble particles of copper oxide exposed and protruding from the surface of the fibers have been demonstrated to have antibacterial, antifungal and antiviral properties (e.g., U.S. Pat. No. 7,169,402). It is clear that rayon fibers similarly impregnated will have a similar effect. Biological activity can be demonstrated using routine assays including, but not limited to, those described in U.S. Pat. No. 7,169,402. Suitable assays include AATCC Test Method 100 and the HIV proliferation assay described in the aforementioned patent.

Textiles and Other Articles of Manufacture

The rayon fibers of the invention with protruding copper oxide particles may be used, for example and without limitation, for any purpose heretofore contemplated for conventional rayon fibers whether in woven or non-woven form. Thus, in one aspect the invention provides a fabric or textile comprising a rayon fiber comprising microscopic water insoluble particles of copper oxide incorporated in said fibers wherein a portion of said particles in said fibers are exposed and protruding from the surface of the fibers and wherein said particles release $Cu^{++}$ when exposed to water or water vapor. In one embodiment the fabric does not contain fibers other than rayon. In one aspect the invention provides a thread or yarn comprising a rayon fiber comprising microscopic water insoluble particles of copper oxide incorporated in said fibers wherein a portion of said particles in said fibers are exposed and protruding from the surface of the fibers and wherein said particles release $Cu^{++}$ when exposed to water or water vapor. In one embodiment the thread or yarn does not contain fibers other than rayon. Further included in the present invention are rayon fibers in non-woven forms such as a sheet with randomly distributed or scattered rayon fibers.

While not in common use, rayon can also be formed as a solid sheath or sheet in which case the copper oxide particles would be incorporated therein and protrude from surfaces thereof.

All publications and patent documents (patents, published patent applications, and unpublished patent applications) cited herein are incorporated herein by reference as if each such publication or document was specifically and individually indicated to be incorporated herein by reference. Citation of publications and patent documents is not intended as an admission that any such document is pertinent prior art, nor does it constitute any admission as to the contents or date of the same.

It will be evident to those skilled in the art that while the invention is not limited to the details of the foregoing illustrative examples and that the present invention may be embodied in other specific forms without departing from the essential attributes thereof, and it is therefore desired that the present embodiments and examples be considered in all respects as illustrative and not restrictive, reference being made to the appended claims, rather than to the foregoing description, and all changes which come within the meaning and range of equivalency of the claims are therefore intended to be embraced therein.

What is claimed is:

1. A method of making a rayon fiber with antibacterial, antifungal and/or antiviral properties comprising (i) adding microscopic, water insoluble, copper oxide particles to a rayon viscose and (ii) extruding the viscose through a spinnerette into an acid bath comprising sulfuric acid, thereby producing a rayon fiber comprising particles of copper oxide wherein a portion of said particles are exposed andprotruding from the surface of the fiber, wherein the copper oxide particles are added in an amount of between 0.25 and 10% of the initial cellulose dry weight, wherein the rayon fiber exhibits antibacterial, antifungal and/or antiviral properties.

2. The method of claim 1, wherein, on average, the dimensions of the copper oxide particles fall in the range between 0.5 and 4 microns.

3. The method of claim 2, wherein the dimensions are in the range of 1 to 2 microns.

4. The method of claim 1 wherein the rayon viscose is made using cellulose from wood pulp.

5. The method of claim 1 wherein the rayon viscose comprises a plasticizer.

* * * * *